United States Patent [19]

Jeffery

[11] Patent Number: 4,498,291

[45] Date of Patent: Feb. 12, 1985

[54] TURBINE OVERSPEED LIMITER FOR TURBOMACHINES

[75] Inventor: Graham J. Jeffery, Bristol, England

[73] Assignee: Rolls-Royce Limited, London, England

[21] Appl. No.: 539,381

[22] Filed: Oct. 6, 1983

[30] Foreign Application Priority Data

Oct. 6, 1982 [GB] United Kingdom ..... 8228584

[51] Int. Cl.[3] ..... F02G 3/00; F01B 25/16; F01D 21/00

[52] U.S. Cl. ..... 60/39.091; 415/9

[58] Field of Search ..... 60/39.091; 415/9; 416/247; 74/609

[56] References Cited

U.S. PATENT DOCUMENTS

| | | | |
|---|---|---|---|
| 1,634,897 | 7/1927 | Davis | 415/9 |
| 2,976,012 | 3/1961 | Allen | 415/9 |
| 3,075,741 | 1/1963 | Laubin | 415/9 |
| 3,490,748 | 1/1970 | Hoffman | 415/9 |
| 3,989,407 | 11/1976 | Cunningham | 60/39.091 |
| 4,004,860 | 1/1977 | Gee | 415/9 |

FOREIGN PATENT DOCUMENTS

| | | | |
|---|---|---|---|
| 624166 | 12/1961 | Canada | 415/9 |
| 993711 | 6/1965 | United Kingdom | 415/9 |
| 2002857 | 2/1979 | United Kingdom | 60/39.091 |

*Primary Examiner*—Louis J. Casaregola

*Assistant Examiner*—Donald E. Stout

*Attorney, Agent, or Firm*—Parkhurst & Oliff

[57] ABSTRACT

A mechanism 25 for preventing a turbine rotor 14 from exceeding a predetermined speed if a shaft 24, connecting the turbine rotor 14 to a compressor rotor 12 of the engine, breaks and releases its axial and torsional constraint on the turbine rotor 14. The mechanism 25 comprises a segmented stator vane assembly 26 downstream of a stage of the turbine rotor 14. Each segment 26 has first and second members 38,40 projecting radially inwards. The first and second members 38,40 are provided respectively at an upstream and downstream region of the inner end of each segment 26. A constraining means 34,36 is provided to constrain the segments 26 against displacement bodily on an axial direction. Static structure of the engine 56 engages the first and second members 38,40 and provides radially outwards and axially rearwards constraint on the first members 38 and radially inwards and axially forwards constraint on the second member 40. When the shaft 24 breaks and the turbine rotor 14 strikes the structure 56 in an axial direction, the structure 56 constrains the first members 38 of each segment 26 and provides a fulcrum about which the segments 26 rotate. Simultaneously the axial and radial constraint on the second members 40 is released causing the gas loads on the segments 26 to tilt then about the fulcrum into the path of the turbine rotor blades.

9 Claims, 4 Drawing Figures

TURBINE OVERSPEED LIMITER FOR TURBOMACHINES

Figure 1:
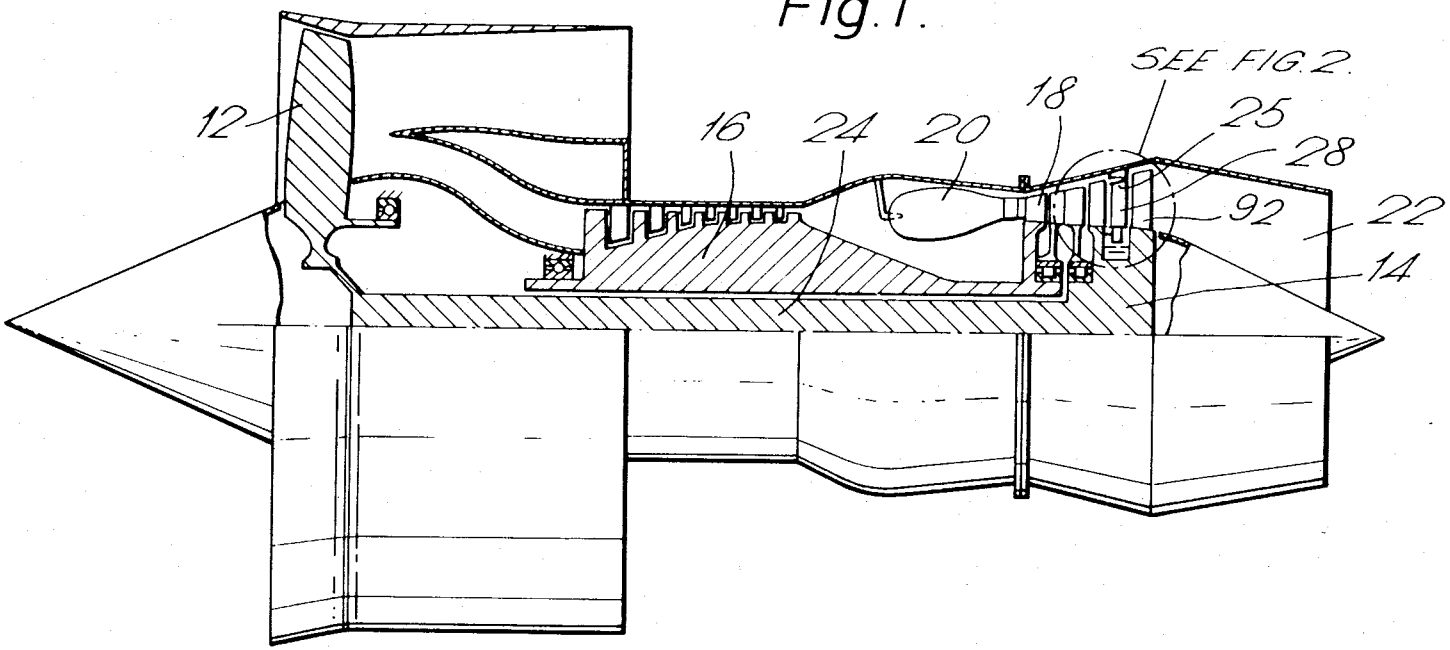

This invention relates to a mechanism for preventing a turbine rotor of a gas turbine engine rotating at an unsafe speed.

A primary requisite in the design of gas turbine engines is that a failure of any component of the engine should not jeopardise the safety of the aircraft to which the engine is fitted, no matter how remote the likeliness of such a failure may be.

This invention addresses itself specifically to the problem of the failure of a shaft which connects a turbine rotor to a compressor or fan rotor.

During normal running the compressor and turbine rotors run at speeds up to predetermined maximum. The aerodynamic forces on the blades of the turbine drive the compressor, and the aerodynamic forces on the compressor oppose the rotation of the turbine rotor. Similarly, the axial load on the turbine is largely balanced by the axial load on the compressor. If a shaft connecting the turbine rotor to the compressor rotor were to break the aerodynamic loads on the turbine rotor accelerate it very rapidly (within a few milliseconds) as there is no opposition provided by the compressor rotor. Consequently, the turbine rotor can accelerate to a speed at which the disc or drum retaining the turbine blades bursts. The blades and disc fragments are then released and subject to an extremely high centrifugal force which can propel them through the engine casings. To provide structure to ensure that in these extreme, and unlikely conditions, all the ejected blades and disc fragments are contained within the engine casings would be very heavy and costly. There is, therefore, a risk that one or more of the blades or disc fragments could damage the aircraft.

The design of the attachments of the compressor rotor to its driving turbine and to the thrust bearing supporting the shaft may be such that if the shaft fails, the turbine rotor is not supported in the thrust bearing but is free to move axially, under the influence of its axial load, and is no longer balanced by the compressor.

It can be shown that simply allowing the rotor to run against a fixed stator structure downstream of the rotor will have no appreciable effect in slowing the rotor down because the heat generated by friction would melt the surfaces of the rotor and the stator vane structures and provide liquid metal lubrication of the rotor for a greater time than it takes for the disc to burst.

The present invention resides in the appreciation that it is possible to design a structure which makes use of the axial movement of the rotor to initiate deceleration of the rotor to safe speeds at which the blades are less likely to be ejected through the engine casings.

An object of this invention is to provide a mechanism for preventing a turbine rotor of a gas turbine engine exceeding a predetermined speed if a shaft, connecting the turbine rotor to a compressor rotor, breaks and releases its torsional and axial constraint on the turbine rotor.

The present invention, as claimed, makes use of the rearwards axial movement of the turbine rotor when the shaft breaks to initiate tilting of the stator vane segments into the path of rotation of the aerofoil blades of the turbine rotor thereby to destroy them and diminish their aerodynamic efficiency in order to decelerate the rotor.

The invention will now be described, by way of examples, with reference to the accompanying drawings in which, FIG. 1 illustrates schematically a gas turbine engine incorporating a mechanism 25, constructed in accordance with the present invention, for preventing a turbine rotor 14 overspeeding if a shaft 24, connecting the turbine rotor to a compressor rotor, breaks.

Figure 2:
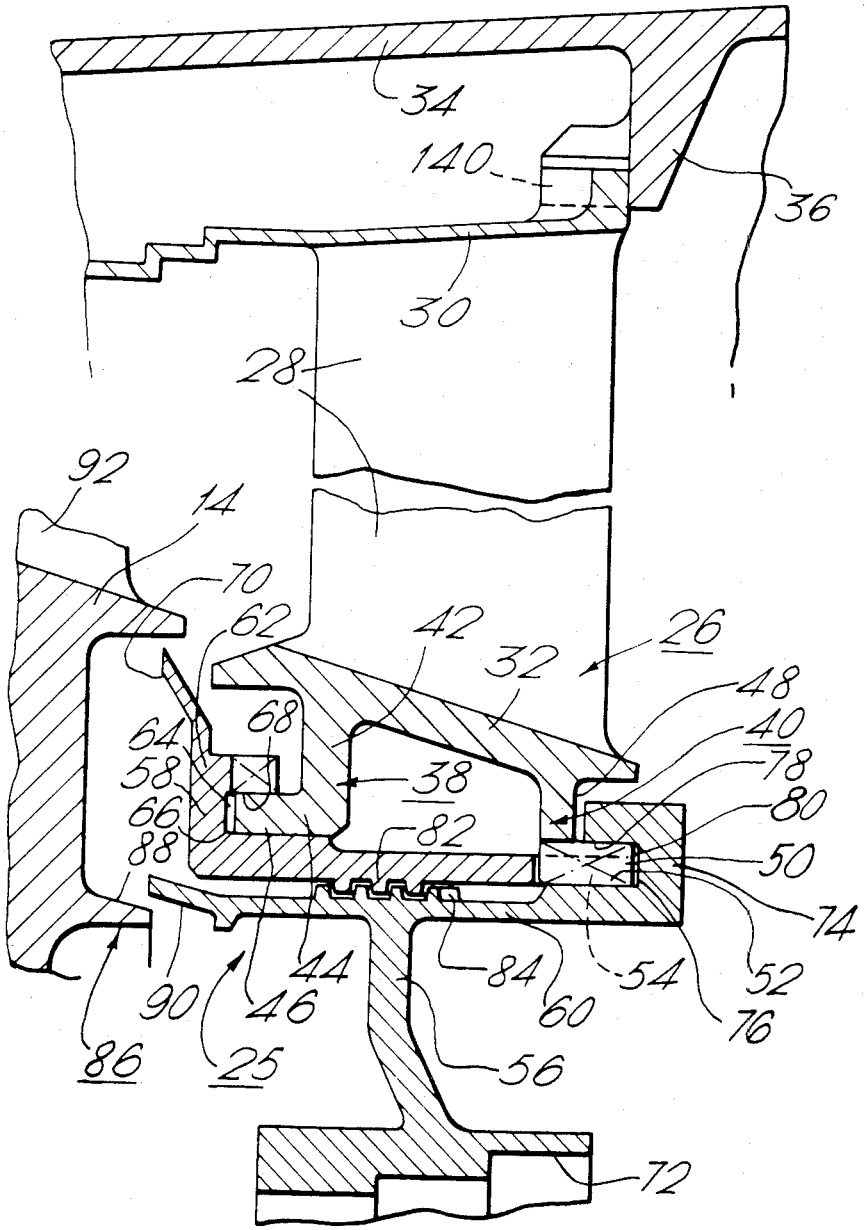
Figure 4:
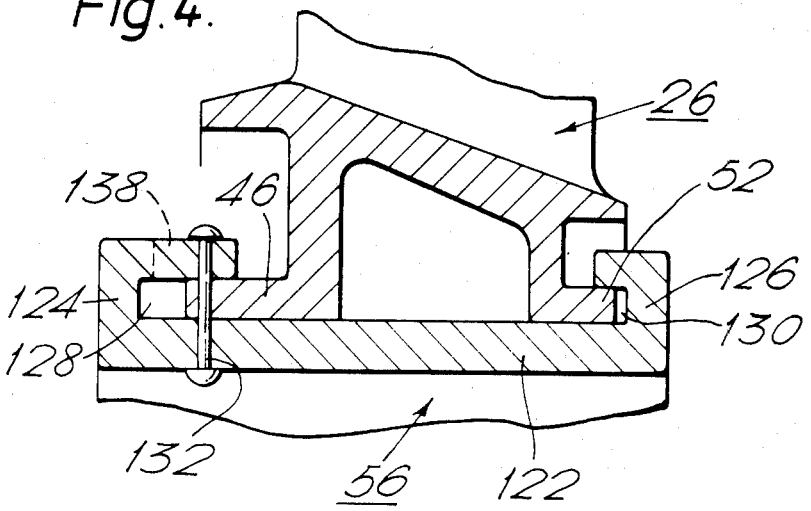
Figure 3:
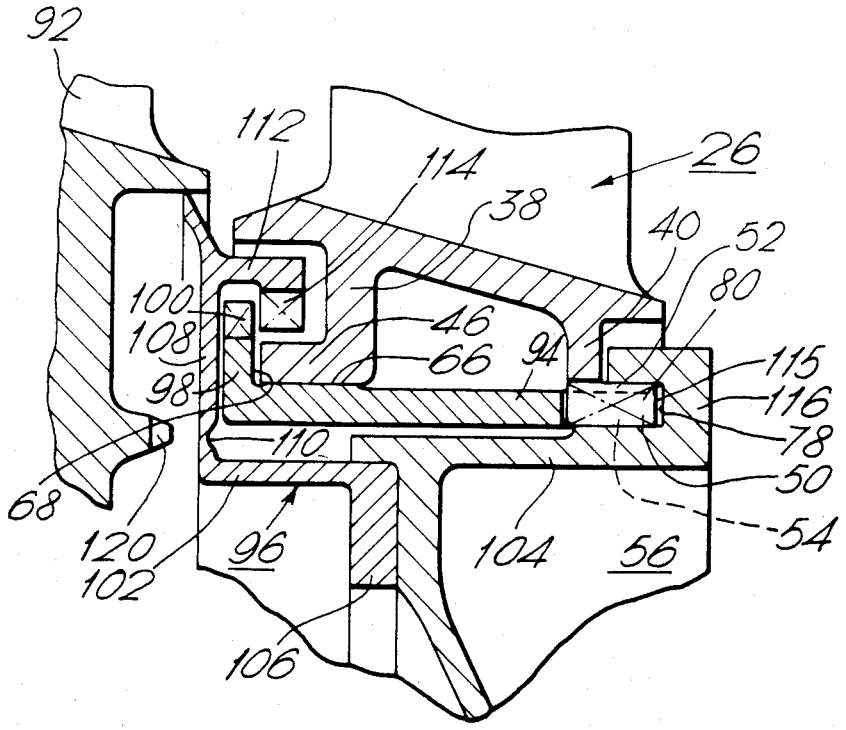

FIGS. 2 to 4 illustrate schematically a radial cross sectional view through part of the low pressure turbine of the engine of FIG. 1, showing three different methods of mounting the inner ends of the NGV segments.

Referring to FIG. 1 there is shown a two spool gas turbine engine of the by-pass type. The engine comprises, a low pressure compressor fan 12 driven by a low pressure turbine 14, a multi-stage axial flow high pressure compressor 16 driven by a high pressure turbine 18, a combustion chamber 20 and a jet pipe 22.

The mechanism for preventing the turbine 14 exceeding a predetermined safe speed if the shaft 24 (which connects the turbine rotor to the compressor 12) breaks, is shown by the reference 25. For convenience only the turbine 14 has been shown as incorporating the mechanism but it is to be understood that the turbine 18 could be provided with a similar mechanism.

Referring specifically to FIG. 2, there is shown the inter-stage nozzle guide vane assembly 26 of a two stage turbine 14. As will be seen the NGV assembly 26 is located on the downstream side of the first stage of the turbine rotor 14 and comprises a plurality of segments 26 each of which consists of a plurality of stator vanes 28 extending between inner and outer shrouds 30, 32.

The turbine outer casing 34 is provided with a flange 36 adjacent the downstream outer ends of the NGV segments 26 against which the NGV segments 26 abut. The flange 36 thereby provides axial constraint against the segments 26 moving rearwards.

Each segment 26 is provided at its radially inner end with two members 38, 40 which project radially inwards. A first of the members 38 is provided at an upstream region of the segment 26 and comprises a radial flange 42 and a portion 44 which projects in a forwards direction to form a hook 46. The second of the members 40 is provided at a downstream region of each segment 26 and comprises a radial flange 48 and a portion 50 which projects rearwards to form a hook 52. Slots 54 are formed in the rear hooks 52 either by slotting the portion 50 or by providing gaps between the portions 50 of adjacent segments 26.

The inner ends of the NGV segments 26 are mounted in fixed structure 56 of the engine which includes two components 58, 60. The first component 58, comprises a hollow cylinder having a radial flange 62 projecting towards the segments 26. The flange 62 has a circumferential recess 64 formed in a rearward facing face of the flange 62 to provide abutment faces 66, 68 which face rearwards (66) and radially outwards (68). The front hooks 46 of each segment 26 locate in the recess 64 and the component 58 thereby imposes an axially outwards and rearwards constraint on the segments 26. The component 58 also has a forward facing flange 70 which co-operates with the first stage rotor 14 to form an air seal.

The downstream end of the first component 58 is slotted so as to fit into the slot 54 in the hooks 46 to prevent the component 58 rotating relative to the segments 26.

The second component 60 comprises a hollow cylinder which carries the static part of a labyrinth interstage air seal 72. The component 60 has a radial flange 74 projecting towards the segments 26. This flange 74 is provided with a circumferential recess 76 in a forward facing face of the flange 76 to provide abutment faces 78, 80 which face radially inwards (78) and forwards (80). The hooks 52 of the second members 40 locate in the recess 76 and bear against the abutment faces 78, 80. The component 60 thereby imposes a radially inwards and axially forwards constraint on the second members 40 of the segment 26.

The first component 58 is provided with a helical thread form 82 on its inside circumferential surface. Similarly the second component 60 is provided with a thread form 84 on its outer circumferential surface, which meshes with the thread form 82 on the first components 58.

The first stage rotor 14 is provided with an engagement device 86 which is in the form of a conical surface 88 which, when the rotor 14 moves rearwards, engages a complementary shaped surface 90 on the second component 60 and forms a simple friction clutch.

If a shaft 24 breaks, the rotor 14 moves rearwards and pushes the first component 58 rearwards to maintain its constraint on the front hooks 46 of all segments 26. Simultaneously, the conical surfaces 88, 90 engage and the second component 60 is screwed axially rearwards relative to the first component 50 to release all the rear hooks 52. The gas loads on the stator vanes segments 26 cause them to rock about the fulcrum formed by the recess 64 in the flange 62. The downstream outer ends of the segments 26 open up circumferentially allowing the upstream regions of the segments 26 progressively to destroy the turbine blades 92. The aerodynamic efficiency of the turbine rotor is thus greatly diminished and the rotor decelerates to a safe speed. The debris from the rotor blades 92 is ejected rearwards and contained within the turbine casings 34 and destroys downstream stages of the turbine 14 and the turbine 18.

It can be arranged that as the segments 26 tilt into the path of the first rotor stage, their inner downstream ends move rearwards into the path of the second stage rotor blades.

Referring now to FIG. 3 there is shown a modification to the structure 56 on which the inner ends of the NGV segments 26 are mounted. The structure 56 comprises two components 94, 96. One of the components 94 provides a radially outward facing abutment face 66 and a rearward facing abutment face 68 against which the first members 38 bear. The component 94 comprises a hollow cylinder which has a radial flange 98 at its upstream end to provide the abutment faces 66, 68. The periphery of the flange 98 is slotted (slots 100) to impart flexibility to the flange 98. The other component 96 consists of two parts 102, 104 which are slotted together. The upstream part 102 comprises a hollow cylinder with a radial flange 106 by which it is bolted to the downstream part 104. The upstream part 102 has a radial flange 108 which has a flangible region 110. The flange 108 extends radially outwards and has a cylindrical lip 112 which encompasses the flange 98 of the component 94 and the outer side of the hooks 46 of the first members 38. The extremity of the lip 112 is slotted (slots 114) to impart flexibility to the lip 112.

The downstream part 104 of the second component 96 has a radial flange 116 which extends towards the segments 26. A recess 115 is provided in the flange 116 to provide a forwards facing abutment face 78 and a radially inwards facing abutment face 80 against which the hooks 52 of the second members 40 locate.

The downstream end of the component 94 is slotted to fit into the slots 54 in the hooks 52.

The first stage rotor 14 has, on its downstream side, a tungsten carbide tipped cutting tool 120 positioned to engage the frangible region 110 of the flange 108 when the shaft 24 breaks and the rotor 14 moves rearwards. At the same time as the flange 108 is cut through, the components 94, 96 are pushed rearwards and retain the front hooks 46 of the segments 26 and release the rear hooks 52. The gas loads on the nozzle guide vanes segments 26 produces a turning moment which pushes the upstream inner end of the segments 26 inwards and pulls the downstream ends outwards. Consequently the gas loads tilts the segments 26 into the path of the turbine blades 92. The slotted flanges 98, 108 are flexible enough not to restrict the tilting movement of the segments 26 into the path of the turbine rotor blades 92.

Referring to FIG. 4 the hooks 46 of the segments 26 are held by a unitary component 122 which is a hollow cylinder with two radial flanges 124, 126. The front flange 124 has a rearward facing recess 128 whereas the rear flange 126 has a forward facing recess 130. The component 122 is dimensioned so that axial movement of the component 122 retains the front hooks 46 but releases the rear hooks 52. To prevent accidental unlatching of the rear hooks 52, shear pins 132 are provided through the front hooks 46 and the component 122. These shear pins 132 are designed to break only when the structure 56 is stuck by the rotor 14 as it moves rearwards when the shaft 24 breaks. To assist in the loading of the segments 26 into the recesses 128, 130, and also provide flexibility to the front flange 124, so as not to restrict the tilting movement of the segments 26 whilst still providing a fulcrum, the flange 124 may be slotted (slots 138). The segments 26 are loaded by inserting the rear hooks 52 into the recess 130 and dropping the front hooks 46 through the slots 138 into the recess 128. The segments 26 are then rotated around the recess 128 to move the hooks 46 out of alignment with the slots 138.

In the above described embodiments, the segments 26 are prevented from rotating relative to the outer casing 34 by circumferentially spaced lugs 140.

I claim:

1. A mechanism for preventing a turbine rotor from exceeding a predetermined speed if a shaft, connecting the turbine rotor to a compressor rotor of the engine, breaks and releases its axial and torsional constraint on the turbine rotor, the mechanism comprising a segmented stator vane assembly downstream of a stage of the turbine rotor, each segment having first and second members projecting radially inwards, the first and second members being provided respectively at an upstream and downstream region of the inner end of each segment, a constraining means located adjacent the radially outer ends of the segments and operable to constrain the segments against displacement bodily on an axial direction, and static structure of the engine constructed and arranged relative to the turbine rotor so that it engages the first and second members and provides radially outwards and axially rearwards constraint on the first members and radially inwards and axially forwards constraint on the second member, and when the shaft breaks and the turbine rotor strikes the structure in an axial direction, the structure retains the first members of each segment and provides a means about which the segments rotate and simultaneously releases its axial and radial constraint on the second member of each segment thereby, in use, causing the gas loads on the segment to tilt an upstream outer region of the segments about the fulcrum into the path of the turbine rotor blades.

2. A mechanism according to claim 1 wherein the first member comprises a forward pointing hook defined by a radial flange projecting radially inwards from the segment and a portion which extends forwards from the free end of the flange, and the structure has a rearward facing recess into which the hook locates.

3. A mechanism according to claim 1 wherein the second member comprises a hook which points rearward and the hook is defined by a second radial flange projecting radially inwards from the segment and a second portion which extends rearwards from a free end of the second flange, and the structure has a forwards facing recess into which the second hook locates.

4. A mechanism according to claim 1 wherein the structure comprises two components, a first of the components being provided to co-operate with the first members and a second of the components being provided to co-operate with the second members, and a releasable means is provided which, in the event of the rotor striking the structure in an axial direction, operates to cause the second component to move rearwards relative to the first component to release the second members.

5. A mechanism according to claim 4 wherein the releasable means comprises a helical thread form on the first component, a means for preventing the first component from rotating, a helical thread form on the second component which meshes with that on the first component, and engagement means on the turbine rotor operable to engage the second component, when the turbine rotor strikes the structure and rotates the second component relative to the first component thereby to effect relative axial displacement between the first and second components.

6. A mechanism according to claim 4 wherein the releasable means comprises a frangible component which is constructed and positioned so as to be machined away by a projection on a rearwards facing face of the turbine rotor when the turbine rotor strikes the structure in a rearwards axial direction, and the frangible component fixes the second component axially relative to the first component until the frangible component breaks.

7. A mechanism according to claim 6 wherein the frangible component is an integral part of the first or the second component.

8. A mechanism according to claim 3 wherein the structure includes an axially displaceable unitary body, which is provided with a rearwards facing recess at an upstream end thereof for receiving the first hooks and forwards facing recess at a downstream end thereof for receiving the second hooks.

9. A mechanism according to claim 8 wherein the upstream recess in the unitary body is embodied in a slotted flange.

* * * * *